US007704386B2

(12) United States Patent
Ventura

(10) Patent No.: US 7,704,386 B2
(45) Date of Patent: Apr. 27, 2010

(54) FILTER ASSEMBLY

(76) Inventor: Gianni Ventura, 24 Uralba St., Figtree, Wollongong, New South Wales (AU) 2525

( * ) Notice: Subject to any disclaimer, the term of this patent is extended or adjusted under 35 U.S.C. 154(b) by 128 days.

(21) Appl. No.: 12/008,158

(22) Filed: Jan. 9, 2008

(65) Prior Publication Data

US 2008/0169228 A1 Jul. 17, 2008

(30) Foreign Application Priority Data

Jan. 12, 2007 (AU) ..... 2007100030

(51) Int. Cl.
*B01D 29/37* (2006.01)
*E03C 1/26* (2006.01)

(52) U.S. Cl. ..... 210/163; 210/164; 210/335; 210/474; 4/289; 4/291

(58) Field of Classification Search ..... 210/163, 210/164, 170.01, 170.03, 335, 337, 339, 210/448, 474, 477, 489, 498; 4/286, 287, 4/289, 290, 291, 292
See application file for complete search history.

(56) References Cited

U.S. PATENT DOCUMENTS

| | | | | | |
|---|---|---|---|---|---|
| 122,209 | A * | 12/1871 | Ashman | 210/163 |
| 287,246 | A * | 10/1883 | Coomber | 4/291 |
| 597,482 | A * | 1/1898 | Russell | 4/289 |
| 783,556 | A * | 2/1905 | Van Buskirk | 210/163 |
| 1,041,887 | A * | 10/1912 | Schodde | 210/163 |
| 1,675,714 | A * | 7/1928 | Koch | 210/163 |
| 2,079,038 | A * | 5/1937 | Ranish | 4/291 |
| 2,472,322 | A * | 6/1949 | Weissman | 210/163 |
| 3,066,802 | A * | 12/1962 | Loffler | 210/163 |
| 3,815,748 | A * | 6/1974 | Johannessen | 210/163 |
| 4,092,747 | A * | 6/1978 | Kessel | 4/286 |
| 4,460,462 | A * | 7/1984 | Arneson | 210/163 |
| 5,037,541 | A * | 8/1991 | Ruey-Jang et al. | 210/498 |
| 6,067,669 | A * | 5/2000 | Peterson et al. | 4/287 |
| 6,270,663 | B1 * | 8/2001 | Happel | 210/163 |
| 6,487,729 | B2 | 12/2002 | Delanzo | |
| 6,537,448 | B2 * | 3/2003 | Houk | 210/164 |
| 2005/0199537 | A1 * | 9/2005 | Kluge | 210/164 |

FOREIGN PATENT DOCUMENTS

| | | |
|---|---|---|
| WO | WO 01/77450 | 10/2001 |
| WO | WO 03/071038 | 8/2003 |
| WO | WO 2004/079109 | 9/2004 |

* cited by examiner

*Primary Examiner*—Christopher Upton

(57) ABSTRACT

A filter assembly (10) for a floor drain including a strainer (11) adapted to be located in the floor drain and a filter basket (13) detachably secured to the strainer (11) on the underside thereof to extend into the floor drain to filter liquid passing through the strainer (11). The strainer (11) includes an upper set of slots (19) and a lower set of slots (18) and may be secured to the strainer (11) by a fastener (29) or frictionally engaged with the strainer (11).

8 Claims, 4 Drawing Sheets

FILTER ASSEMBLY

TECHNICAL FIELD

This invention relates to a filter assembly and in particular to a filter assembly for use in drains such as in drains in showers, baths, sinks or floors.

BACKGROUND ART

Showers are conventionally provided with a floor drain through which water is drained from the shower into the plumbing system for passage to waste. Such drains typically include a perforated or grid-like strainer through which liquid flows into the drain for flow to waste however the strainers which are employed have openings of such a size that solid materials particularly hair and skin still pass from the shower recess through the strainer and thus into the drain. This can cause blockages in the drain causing possible internal flooding. Alternatively the plumbing system can become blocked necessitating cleaning or unblocking by skilled persons such as plumbers. This can be expensive particularly if the blockages occur in locations where excavations are required to be carried out to gain access to the plumbing system where blockages have occurred. Similar problems can be encountered with drains which are used in baths, sinks, basins or simply in floors.

SUMMARY OF THE INVENTION

The present invention aims to provide a filter assembly for use with a drain of a shower, bath, basin, floor or other location from which liquid is to be drained which overcomes or at least alleviates the above disadvantages. The present invention in a further aspect aims to provide a filter assembly for use with drains to reduce the possibility of blockages in the drain or plumbing system associated with the drain. Other objects and advantages of the invention will become apparent from the following description.

The present invention thus provides a filter assembly for a floor drain, said filter assembly including a strainer adapted to be located in said floor drain, and filter means detachably secured to said strainer on the underside thereof and adapted to extend into said floor drain to filter liquid passing through said strainer.

The term "floor drain" as used throughout the specification and claims includes a drain in the floor or base of a shower, bath, basin, floor or any other drain for draining liquid from a particular area.

Typically, the strainer is of a disc-like form and provided with a plurality of apertures or slots therein through which liquid can pass. Some solid materials however will also pass through the apertures or slots in the strainer into the drain however these in the main will be captured by the filter means located beneath the strainer.

Preferably, the filter means comprises a hollow filter basket. The filter basket suitably includes a side wall having a plurality of slots or openings through which water may pass. The slots or openings may comprise an upper set of slots or openings and a lower set of slots or openings. Preferably the slots are slots which extend generally longitudinally of the filter basket. The slots in the upper set of slots are preferably of a greater cross sectional area or greater width than the slots in the lower set of slots. Thus if the lower set of slots tend to become blocked or partly blocked, liquid can still flow through the filter basket by passing through the slots of the upper set.

The filter basket may be of a generally cup shaped configuration. Preferably the filter basket has a lower frustoconical outer wall portion containing the first set of slots and an upper frustoconical outer wall portion containing the second set of slots. Preferably the first set of slots are defined by a plurality of spaced apart first elongated elements or ribs. The slots of the first set may increase in width in a tapering manner towards their lower ends. Preferably the second set of slots are defined by a plurality of second elements or ribs. Preferably the filter basket includes an upper annular rim and the second elements or ribs extend downwardly from the upper rim. Preferably the filter basket includes an intermediate annular rib below the rim and the second elements or ribs extend between the annular rim and intermediate annular rib. Preferably the first elongated elements or ribs extend between the intermediate annular member and a base of the basket. The elongated elements or ribs preferably comprise hollow elongated ribs. The ribs are suitably filled with talc.

For attachment to the strainer, the filter basket may include an attachment post and the strainer is releasably secured to the filter basket by a fastener engaged with the attachment post. The attachment post may be arranged centrally of the filter basket and extend upwardly from the base of the basket. Preferably the attachment post is hollow at least at its upper end for engagement by the fastener. Suitably the attachment post is internally threaded and the fastener comprises an attachment screw passed through the strainer and threaded into the attachment post. The strainer is preferably centrally apertured to receive the attachment screw.

The above described arrangement is suitably for retrofitting to an existing strainer which may be removed from a drawn opening, centrally drilled to enable a fastener to be passed therethrough to secure the filter basket to the strainer and reinserted into the drain opening.

In an alternative arrangement suitable for installations into new buildings, the filter basket is suitably frictionally engaged with the underside of the strainer. For this purpose, the strainer is preferably provided on its underside with an annular rib adapted for frictional engagement by the upper rim of the filter basket. For connection to a drain pipe, the filter assembly may include a coupling adapted to be connected to the drain pipe. The coupling suitably is of tubular configuration and has an internal diameter substantially the same as the outer diameter of a drain pipe to which the coupling is to be connected. Preferably the coupling has a shoulder at its upper end which defines a seat for the strainer. The shoulder is suitably surrounded by an annular rim and the strainer when seated on the shoulder is suitably flush with the annular rim. The coupling is typically installed so as to be substantially flush with a floor or base of the liquid container.

The filter basket of course may be attached to strainer by any other form of attachment means such as screw fasteners, clips or other form of fastener.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE DRAWINGS

Figure 1:
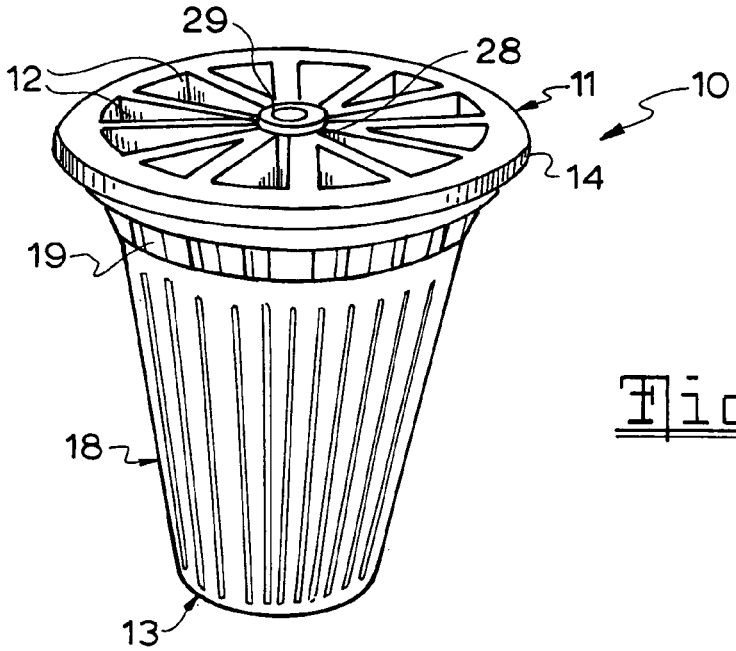
FIG. 1 is a side view of a filter assembly according to a first embodiment of the invention.
Figure 2:
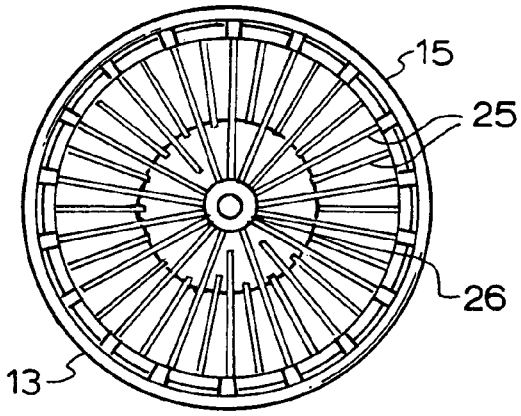
FIGS. 2 and 3 are plan and side views of the filter basket of the filter assembly of FIG. 1.
Figure 3:
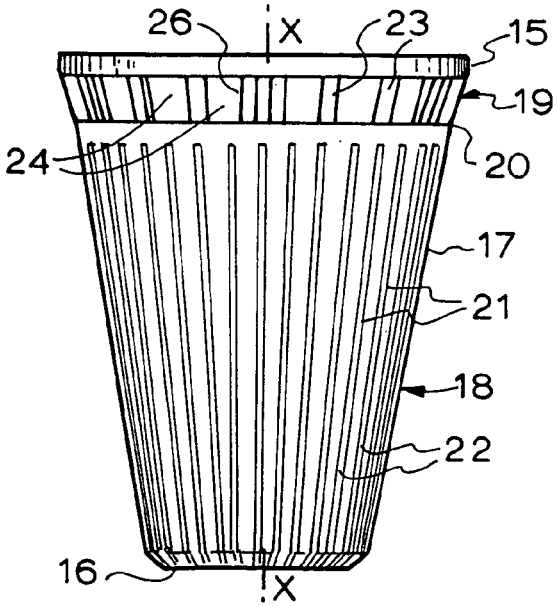
Figure 4:
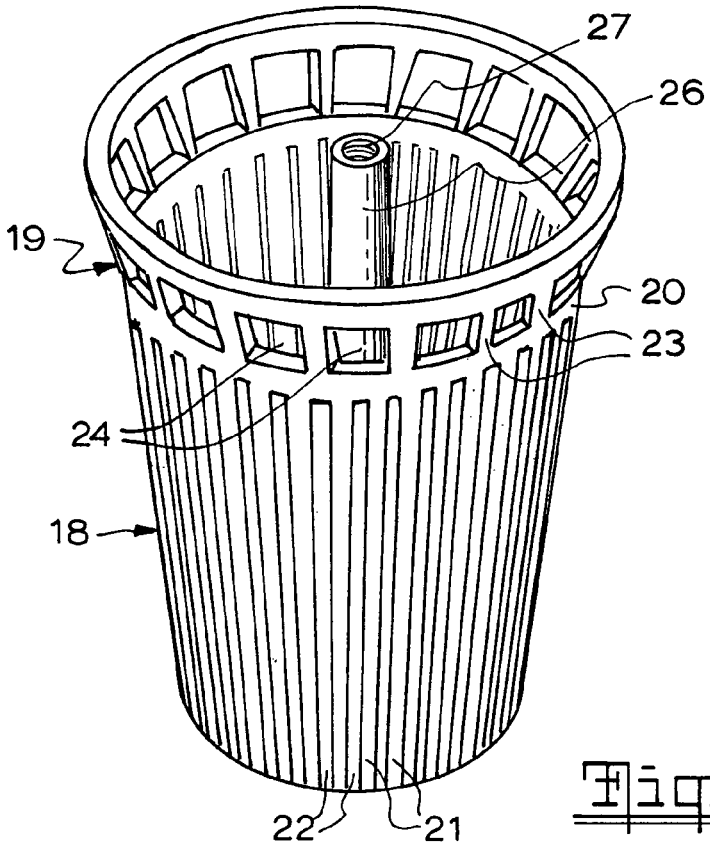
FIGS. 4 and 5 are perspective views of as slightly modified form of filter basket.
Figure 5:
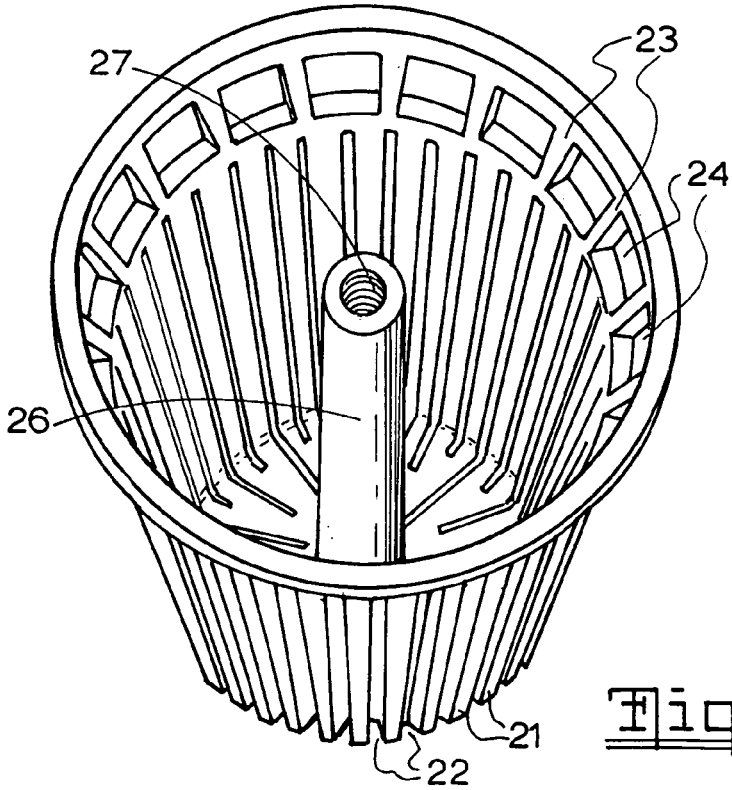

Referring to the drawings and firstly to FIG. 1 there is illustrated a filter assembly 10 for use in a combination with a waste or drain pipe according to an embodiment of the present invention. The filter assembly 10 includes a strainer 11 of conventional grating-like form being of a generally disc-like configuration and including a plurality of radially extending drain apertures or slots 12 therein and a filter basket 13 mounted to the underside of the strainer 11, the filter basket 13 having a central longitudinally extending axis X-X. The strainer 11 is typically received in a terminating pipe fitting or socket which is connected to a drain pipe and which is fitted within the floor or base to be drained and has an outer annular flange portion 14 which seats on a shoulder in the pipe fitting or socket so as to be substantially flush with the floor or base. Thus where the floor is a floor of concrete or the like, the pipe fitting or socket is embedded within the concrete floor. In the case of a basin, the pipe fitting or socket is secured to the base of the basin at the drain opening.

As shown more clearly in FIGS. 2 to 5, the filter basket 13 comprises a cup-shaped body which is of a circular cross-section centered on the axis X-X and which has an upper annular rim 15, a circular base 16 spaced from the rim 15 along the axis X-X and a frustoconical outer wall 17 around the axis X-X which extends between the rim 15 and base 16. The frustoconical wall 17 comprises a lower wall portion 18 extending upwardly from the base 16 and an upper wall portion 19 extending downwardly from the rim 15, the upper and lower wall portions 19 and 18 meeting at an annular rib 20.

The lower wall portion 18 is defined by a plurality of circumferentially spaced elongated ribs 21 defining elongated slots 22 therebetween extending between the base 16 and annular rib 19. The upper wall portion 19 is also defined by a plurality of circumferentially spaced ribs 23 extending between the rim 14 and annular rib 20 and defining enlarged slots 24 therebetween. The slots 24 are substantially larger in circumferential width than the slots 21. The slots 22 may also taper in width from the top towards their bottom so as to be of greater width at their bottoms to enhance drainage.

The base 16 of the filter basket 13 is provided with a plurality of radially extending slots 25 extending inwardly from the periphery of the base 16 towards the centre thereof. At least some of the slots 25 comprise continuations of the slots 22 and alternative slots 25 have different lengths in the radial direction.

The filter basket 13 additionally includes a central post 26 formed integrally with and extending upwardly from the base 16 and extending along the axis X-X, the upper end of the post 26 being hollow and internally threaded as at 27.

The filter basket 13 is preferably integrally formed of plastics such as polypropylene and is injection moulded. The ribs 21 and 23 may be hollow and filled with talc.

In use and for installation of a filter basket 13 in an installed floor drain having an existing strainer 11, the strainer 11 is initially removed from the drain and a central aperture 28 formed therethrough in such as by drilling. A filter basket 13 is then positioned relative to the strainer 11 such that the central aperture 28 is aligned with the post 26. The strainer 11 can then be secured to the filter basket 13 by means of a screw 29 typically a stainless steel screw which is screwed through the aperture 28 in the strainer 11 into the threaded post 26. The strainer 11 with attached basket 13 may then be reinserted into the drain, the strainer 11 locating in its normal position on a shoulder in the drain end fitting and the filter basket 13 extending into the drain pipe.

The filter assembly 10 will function in the manner of a normal strainer 11 to drain water or other liquids except that solid materials such as hair or skin passing through the strainer 11 will be captured in the filter basket 13 and thus be prevented from entering the plumbing of the dwelling or from passing into the main drainage system. The strainer 11 with attached filter basket 13 may be removed at regular intervals to enable cleaning of the filter basket 13 and/or cleaning and/or replacement. Should the slots 22 in the lower portion of the filter basket 13 become blocked or partially blocked, the upper enlarged slots 23 will allow drainage of water to avoid flooding. The filter basket 13 is preferably made of a size to fit different size floor drains but may be made in different sizes for differed sized floor drains. If desired also a crystalline antiseptic or antibacterial material may be added to the basket 13 so that water passing through the basket 13 is exposed to such material.

Figure 6:
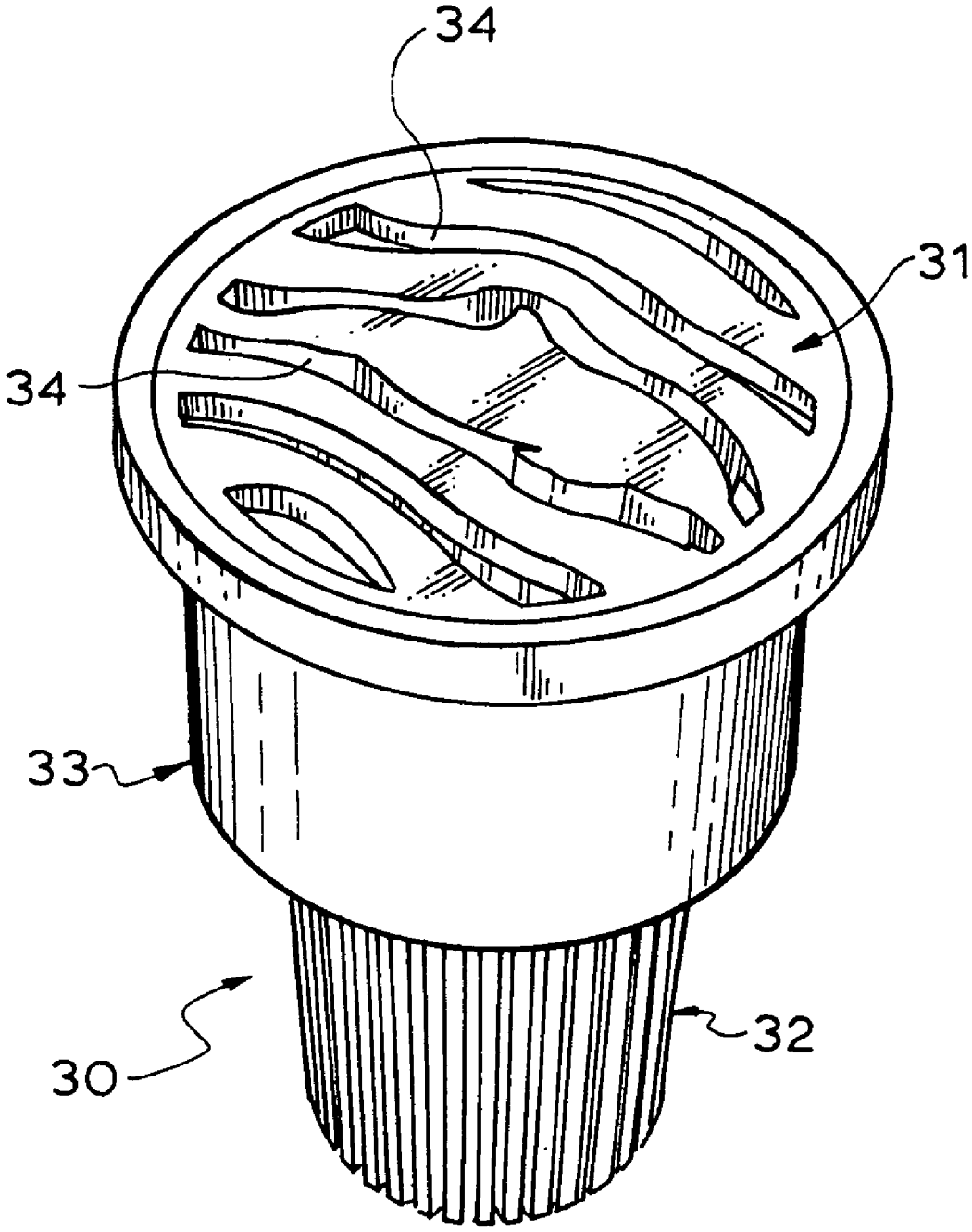
FIG. 6 illustrates a filter assembly according to a second embodiment of the invention.
Figure 7:
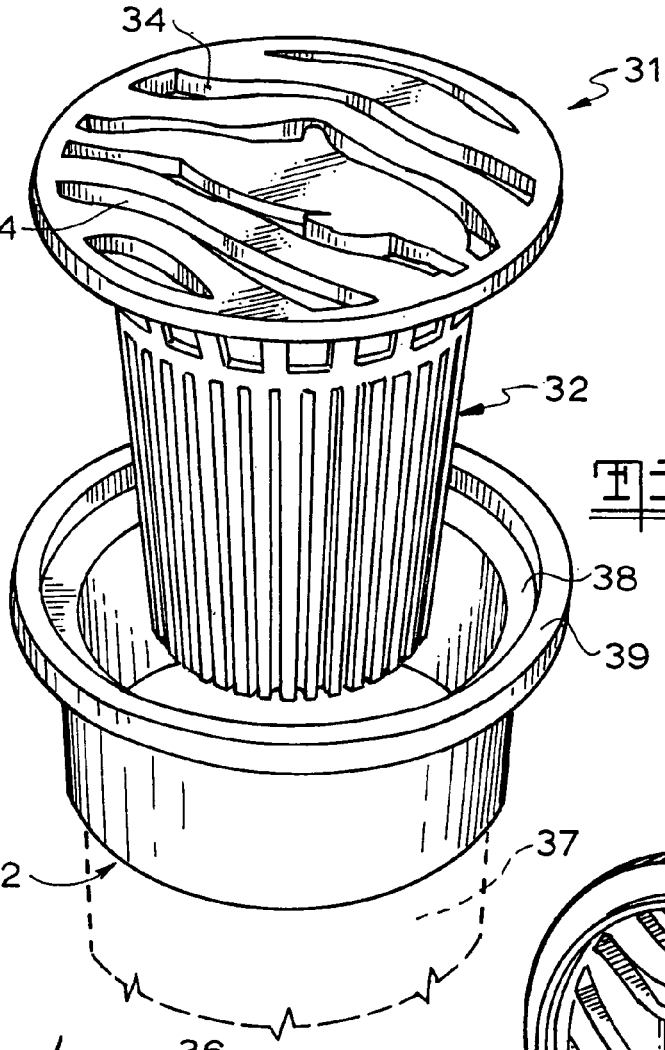
FIG. 7 is an exploded view of the filter assembly of FIG. 6.
Figure 8:
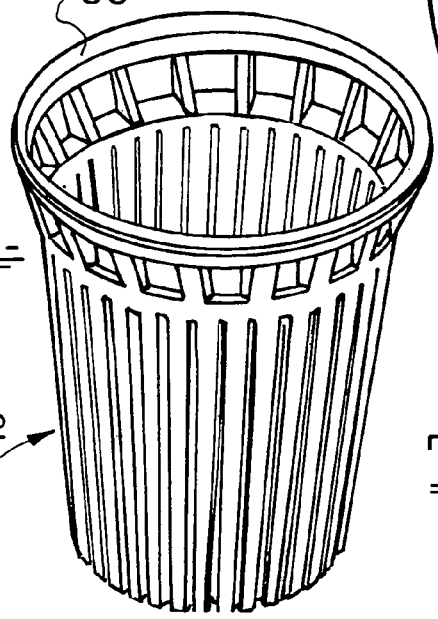
FIG. 8 illustrates the separated filter basket and strainer of the filter assembly of FIG. 7.
Figure 8:
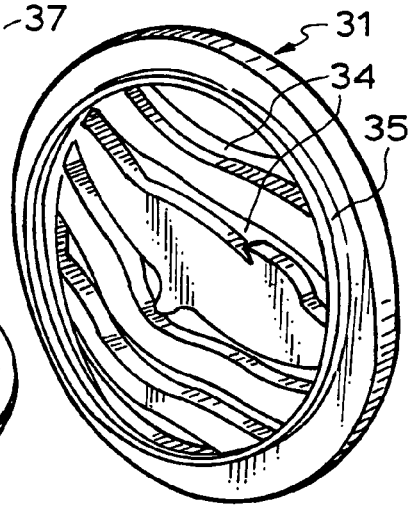

Referring now to FIGS. 6 to 8 there is illustrated a further embodiment of filter assembly 30 according to the present invention including a strainer or grating 31, a filter basket 32 and a drain coupling 33 for coupling the filter assembly 30 to a drain pipe. The strainer 31 is of disc-like configuration including slots or openings 34 therethrough which may be or any configuration for the passage of water through the strainer 31. The underside of the strainer 31 includes an annular rib 35 of a rectangular cross section located radially inwardly from the outer periphery of the strainer 31.

Figure 7A:
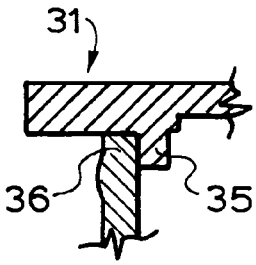
FIG. 7A is a sectional view of portion of the rim of the strainer showing its connection with the filter basket of the filter assembly of FIG. 6.

The filter basket 32 is of similar construction to the filter basket 13 of FIGS. 2 to 5 however with the central post 26 excluded. The annular upper rim 36 of the basket 32 is slightly internally flared outwardly on its inner side as is apparent in FIGS. 7A and 8 and has an internal diameter similar to the outer diameter of the rib 35. The basket 13 can thus be pushed onto the underside of the strainer 31 with the frictional engagement between the rim 36 and rib 35 securing the basket 32 to the strainer 31.

The coupling 33 is of generally tubular configuration and has in inner diameter such that it may be connected to a drain pipe 37 (shown in dotted outline in FIG. 7) using suitably adhesives. The upper end of the coupling 33 has an outwardly stepped shoulder 38 surrounded by a rim 39, the latter having an internal diameter substantially the same as the external diameter of the strainer 31.

In use, the coupling 33 is installed in a floor by being connected to a drain pipe 37 and such that the upper edge of the rim 39 is substantially flush with the upper surface of the floor, floor tiles or the like. The strainer 31 with frictionally attached filter basket 32 may then be inserted into the coupling 33 so that the strainer 31 seats on the shoulder 38 to be substantially flush with the upper edge of the rim 39.

As with the embodiment of FIGS. 1 to 5, water will pass through the strainer 31 and through the filter basket 32 and into the drain pipe 37. Foreign materials such as hair entering the basket 32 will not pass into the drain pipe 37 but be caught within the basket. The basket 32 will also serve to catch jewelry falling through the strainer 31.

For cleaning purposes, the strainer 31 and attached filter basket 32 may be removed from the coupling 33 and the filter basket 32 detached from the strainer 31 if required for cleaning or for replacement.

Whilst the filter baskets are shown to have slots therein for passage of fluid therethrough, the slots alternatively may be replaced by apertures of any shape or size. Apertures may be provided in upper and lower sets corresponding to the slots in the upper and outer sets. Thus the apertures in the upper set may be of a greater cross sectional area than the apertures in the lower set. The filter basket and strainer may also be of various sizes to suit the drain size such as 50 mm, 80 mm and 100 mm.

The terms "comprising" or "comprises" as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as herein described in the appended claims.

The invention claimed is:

1. A filter assembly for a drain in the base of a bath, basin, sink, shower or in a floor, said drain having a waste or drain pipe and a tubular end pipe fitting or socket at the end of the waste or drain pipe and set within the base or floor, said end pipe fining or socket having a shoulder therein, said filter assembly comprising:

a strainer of a disc shape adapted to be located in said end pipe fitting or socket of said drain to seat on said shoulder and be substantially flush with the surface of said floor or base adjacent said socket or fitting, and a hollow filter means detachably secured to said strainer on the underside thereof and adapted to extend into said drain to filter liquid passing through said strainer, said filter means comprising a hollow filter basket, said filter basket being integrally moulded of plastics and having a central longitudinally extending axis, an annular rim at an upper end and a base at a lower end, said base having a plurality of openings therein and being spaced along said central axis from said annular rim and a frustoconical side wall centred on said axis and extending between and joining said base and said annular rim, said side wall having an upper frustoconical wall portion and a lower frustoconical wall portion, said upper frustoconical wall portion being defined by a plurality of substantially longitudinally extending circumferentially spaced apart ribs defining therebetween an upper set of slots or openings spaced around said axis and said lower frustoconical wall portion being defined by a plurality of substantially longitudinally extending circumferentially spaced apart ribs defining therebetween a lower set of slots or openings spaced around said axis, said ribs of said upper frustoconical wall portion being spaced apart a circumferential distance greater than the circumferential distance between the ribs of said lower frustoconical wall portion such that said slots or openings in the upper set are of a greater cross sectional area than the slots or openings in the lower set, and wherein said strainer with the filter means attached are removable from said end fitting or socket for cleaning.

2. A filter assembly as claimed in claim 1 wherein said side wall includes an annular rib extending circumferentially of said filter basket and wherein said ribs of said first set extend between said annular rib and said base.

3. A filter assembly as claimed in claim 2 wherein said ribs of said upper frustoconical wall portion extend between said annular rim and said annular rib, said ribs being inclined outwardly from said annular rib to join said rim.

4. A filter assembly as claimed in claim 1 wherein said base includes a plurality of radially extending slots.

5. A filter assembly as claimed in claim 1 wherein said filter basket includes a central attachment post extending from said base along said central axis and wherein said strainer is releasably secured to said filter basket by a fastener engaged with said attachment post.

6. A filter assembly as claimed in claim 1 wherein said filter basket is frictionally engaged with the underside of said strainer.

7. A filter assembly as claimed in claim 6 wherein said strainer includes an annular rib on its underside, said annular rim of said filter basket being frictionally engaged with said annular rib.

8. A filter assembly as claimed in claim 1 wherein said apertures in said base comprise a plurality of radially extending slots, at least some of said slots comprising continuations of the of said lower set.

* * * * *